US011802498B2

(12) United States Patent
Waugaman

(10) Patent No.: US 11,802,498 B2
(45) Date of Patent: Oct. 31, 2023

(54) OIL DISTRIBUTION BLOCKS AND EXTERNAL OIL DISTRIBUTION SYSTEMS COMPRISING THE SAME

(71) Applicant: Curly's Inc., Burns Harbor, IN (US)

(72) Inventor: Lance Waugaman, Porter, IN (US)

(73) Assignee: Curly's Inc., Burns Harbor, IN (US)

( * ) Notice: Subject to any disclaimer, the term of this patent is extended or adjusted under 35 U.S.C. 154(b) by 0 days.

(21) Appl. No.: 18/068,616

(22) Filed: Dec. 20, 2022

(65) Prior Publication Data

US 2023/0193794 A1 Jun. 22, 2023

Related U.S. Application Data

(60) Provisional application No. 63/292,477, filed on Dec. 22, 2021.

(51) Int. Cl.

| | |
|---|---|
| ***F01M 11/02*** | (2006.01) |
| ***F01P 3/02*** | (2006.01) |
| ***F01M 5/00*** | (2006.01) |
| ***F01M 11/00*** | (2006.01) |

(52) U.S. Cl.

CPC ..... *F01M 11/02* (2013.01); *F01M 5/002* (2013.01); *F01M 11/0004* (2013.01); *F01P 3/02* (2013.01); *F01M 2011/0033* (2013.01); *F01P 2003/024* (2013.01); *F01P 2060/04* (2013.01)

(58) Field of Classification Search

CPC .... F01M 11/02; F01M 5/002; F01M 11/0004; F01M 2011/0033; F01P 3/02; F01P 2003/024; F01P 2060/04

See application file for complete search history.

(56) References Cited

U.S. PATENT DOCUMENTS 4,392,464 A 7/1983 Woodward et al.
8,887,688 B1 * 11/2014 Neal ..... F01M 1/10 123/196 R

* cited by examiner

*Primary Examiner* — Jacob M Amick

(74) *Attorney, Agent, or Firm* — Hartman Global IP Law; Gary M. Hartman; Domenica N. S. Hartman

(57) ABSTRACT

Oil distribution blocks and oil distribution systems equipped therewith. Such an oil distribution block includes a rigid block body configured to be secured to a cylinder head of an engine, an oil inlet, and an oil outlet. The oil inlet is configured to be releasably coupled to a first oil distribution line or a fitting therebetween, receive a flow of oil therefrom, and route the oil to an inlet of a cooling passage of the cylinder head. The oil outlet is configured to be releasably coupled to a second oil distribution line or a fitting therebetween, receive a flow of oil from an outlet of the cooling passage of the cylinder head, and route the oil to the second oil distribution line. The oil inlet and the oil outlet are configured to threadably couple with the first and second oil distribution lines, respectively, or the fittings therebetween.

19 Claims, 6 Drawing Sheets

OIL DISTRIBUTION BLOCKS AND EXTERNAL OIL DISTRIBUTION SYSTEMS COMPRISING THE SAME

CROSS-REFERENCE TO RELATED APPLICATIONS

This application claims the benefit of U.S. Provisional Application No. 63/292,477 filed Dec. 22, 2021, the contents of which are incorporated herein by reference.

BACKGROUND OF THE INVENTION

The present invention generally relates to oil distribution systems of engines. The invention particularly relates to oil distribution blocks suitable for attachment to front and rear cylinder heads of engines, including motorcycle engines, that provide for threaded coupling to removable oil distribution lines.

The Harley-Davidson® M8 engine was first introduced in 2016 (i.e., certain 2017 models) and represented the ninth generation of Harley-Davidson®'s "big twin" engines. The M8 engine is currently available in 107 cu in (1,750 cc), 114 cu in (1,870 cc), and 117 cu in (1,920 cc) versions. All of the versions of the M8 engine include two cylinders with four valves per cylinder for a total of eight valves in a traditional V-twin configuration with cylinders oriented at 45 degrees to each other.

The M8 engine includes a combination air-cooled and oil-cooled system to cool the engine's front and rear cylinder heads. In the oil system, oil is drawn from the engine's oil pan by a pump and pumped through an engine-to-oil cooler hose to an oil cooler located at the front of the engine, where the heat of the oil is exchanged with air that surrounds the oil cooler and flows through the oil cooler while the motorcycle is moving. From the oil cooler, the oil flows through an oil cooler-to-downtube hose to a downtube. From the downtube, the oil flows through a supply oil line where the oil splits into two separate flow paths and travels to front and rear manifolds of the engine's front and rear cylinder heads, respectively. For convenience, portions of the supply oil line downstream of the split are referred to herein as front and rear cylinder head feed lines. Within the front and rear cylinder heads, the oil flows through cooling passages that route the oil between the exhaust valve seats for cooling these critical areas of the engine. The oil is then routed back through the manifolds. Oil exiting the front manifold flows through a return oil line and enters the rear manifold at which point the oil from the two separate flow paths recombine. The recombined oil then exits the rear manifold and flows through a rear oil hose to be returned to the oil pan.

The front and rear manifolds each include a rigid block body bolted to the front and rear cylinder heads, respectively. The supply oil line and the return oil line are formed of rigid materials (e.g., "hard lines") fixed to respective inlets and outlets of the front and rear manifolds. Therefore, the supply oil line and the return oil line are not intended to be easily disconnected from the front and rear manifolds, especially by end consumers. However, it can be appreciated that it would be desirable if the supply oil line and/or the return oil line could be removed in order to promote ease of maintenance.

BRIEF DESCRIPTION OF THE INVENTION

The intent of this section of the specification is to briefly indicate the nature and substance of the invention, as opposed to an exhaustive statement of all subject matter and aspects of the invention. Therefore, while this section identifies subject matter recited in the claims, additional subject matter and aspects relating to the invention are set forth in other sections of the specification, particularly the detailed description, as well as any drawings.

The present invention provides oil distribution blocks and oil distribution systems comprising the same. The oil distribution blocks are configured for easy removal of supply oil lines, return oil lines, and/or rear oil hoses in order to promote ease of maintenance of an engine, for example, a motorcycle engine.

According to a nonlimiting aspect of the invention, an oil distribution block is provided that includes a rigid block body configured to be secured to a cylinder head of an engine, an oil inlet configured to be releasably coupled to a first oil distribution line or a fitting therebetween, receive a flow of oil therefrom, and route the oil to an inlet of a cooling passage of the cylinder head, and an oil outlet configured to be releasably coupled to a second oil distribution line or a fitting therebetween, receive the flow of oil from an outlet of the cooling passage of the cylinder head, and route the oil to the second oil distribution line. The oil inlet and the oil outlet are configured to threadably couple with the first and second oil distribution lines, respectively, or the fittings therebetween.

According to another nonlimiting aspect of the invention, an external oil distribution system is provided for directing a flow of oil to and from cooling passages of front and rear cylinder heads of a motorcycle engine, for example, a Harley-Davidson® M8 engine. The external oil distribution system includes front and rear cylinder head feed lines configured to transport oil to the cooling passages of the front and rear cylinder heads, respectively, a Tee fitting configured to receive and combine the oil from the cooling passages of the front and rear cylinder heads, a return oil line configured to transport the oil from the cooling passage of the front cylinder head to the Tee fitting, a rear oil hose configured to receive the oil from the Tee fitting, and front and rear oil distribution blocks. The front oil distribution block includes a rigid block body configured to be secured to the front cylinder head, an oil inlet configured to be releasably coupled to the front cylinder head feed line or a fitting therebetween, receive the oil therefrom, and route the oil to an inlet of the cooling passage of the front cylinder head, and an oil outlet configured to be releasably coupled to the return oil line or a fitting therebetween, receive the oil from an outlet of the cooling passage of the front cylinder head, and route the oil to the return oil line. The rear oil distribution block includes a rigid block body configured to be secured to the rear cylinder head, an oil inlet configured to be releasably coupled to the rear cylinder head feed line or a fitting therebetween, receive the oil therefrom, and route the oil to an inlet of the cooling passage of the rear cylinder head, and an oil outlet configured to be releasably coupled to the Tee fitting, receive the oil from an outlet of the cooling passage of the rear cylinder head, and route the oil to the Tee fitting. The oil inlet and the oil outlet of both of the front and rear oil distribution blocks include threads configured to threadably couple with one or more of the front and rear cylinder head feed lines, the Tee fitting, the return oil line, the rear oil hose, or the fittings therebetween.

Other nonlimiting aspects of the invention include a method of modifying a factory standard oil distribution system of a motorcycle engine, for example, a Harley-Davidson® M8 engine, with the external oil distribution system described above and a kit comprising a pair of oil distribution blocks of the type described above.

Technical effects of oil distribution blocks and oil distribution systems as described above preferably include the ability to be attached to front and rear cylinder heads of engines that provide for threaded coupling to removable oil distribution lines, as a nonlimiting example, motorcycle engines such as the Milwaukee-Eight® (M8) engine commercially available from Harley-Davidson, Inc. The oil distribution blocks and oil distribution systems are preferably able to promote the ease with which supply oil lines (i.e., the front and rear cylinder head feed lines), return oil lines, and/or rear oil hoses can be removed to promote ease of maintenance.

Other aspects and advantages of this invention will be appreciated from the following detailed description.

DETAILED DESCRIPTION OF THE INVENTION

Figure 1B:
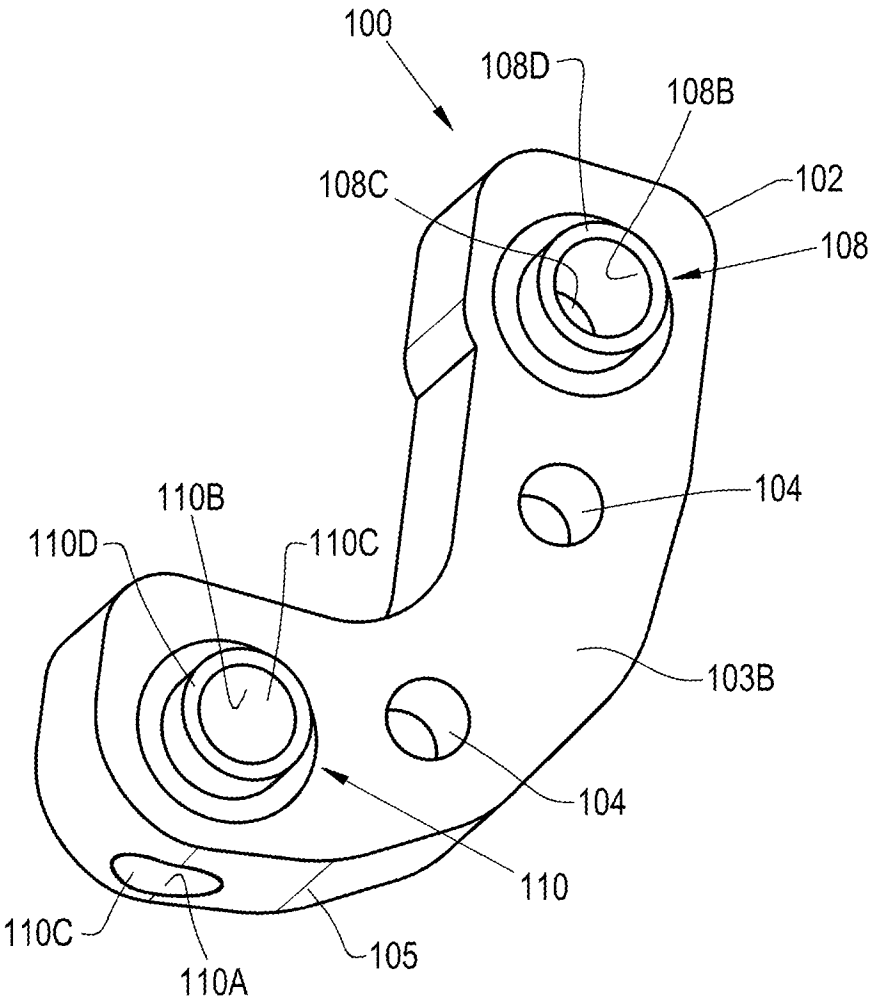
FIGS. 1A and 1B represent views of opposite surfaces of a front oil distribution block in accordance with certain nonlimiting aspects of the invention.

The intended purpose of the following detailed description of the invention and the phraseology and terminology employed therein is to describe what is shown in the drawings, which include the depiction of nonlimiting embodiments of the invention, and to describe certain but not all aspects of the embodiment(s). The following detailed description also identifies certain but not all alternatives of the embodiment(s). Therefore, the appended claims, and not the detailed description, are intended to particularly point out subject matter regarded to be aspects of the invention, including certain but not necessarily all of the aspects and alternatives described in the detailed description.

FIGS. 1A and 1B and FIGS. 2A and 2B represent nonlimiting embodiments of, respectively, a front oil distribution block 100 and a rear oil distribution block 200 suitable for coupling oil distribution lines to, respectively, front and rear cylinder heads of a motorcycle engine, as a particular but nonlimiting example, the front and rear cylinder heads 300 and 302 of a Harley-Davidson® M8 engine as depicted in FIGS. 3 through 6. Although the front and rear oil distribution blocks 100 and 200 are discussed hereinafter in relation to the Harley-Davidson® M8 engine, it is foreseeable and within the scope of the invention that the front and rear oil distribution blocks 100 and 200 or modified embodiments thereof may be configured for use with other type of engines and therefore the invention is not limited to the specific embodiments described herein.

Figure 1A:
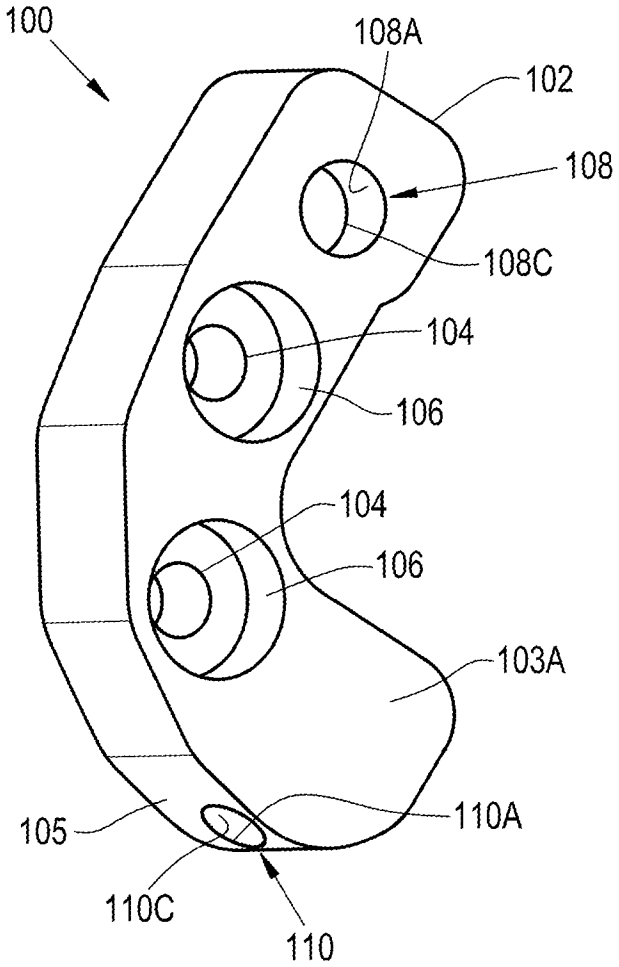

The front oil distribution block 100 is represented in FIGS. 1A and 1B as comprising a rigid block body 102 configured to couple with the front cylinder head 300 of the engine. In certain cases, the front oil distribution block 100 may be a replacement for a front manifold that is factory standard for the Harley-Davidson® M8 engine. The block body 102 may generally be described as having a rounded L-shape with an outer face 103A configured to face outward away from the front cylinder head 300, and an inner face 103B that is opposite the outer face 103A and configured to face inward toward the front cylinder head 300. The block body 102 has a continuous sidewall 105 that is between and separates the outer face 103A and the inner face 103B.

The block body 102 includes a pair of mounting holes 104 having axes that are depicted as roughly perpendicular to the outer face 103A of the block body 102. The mounting holes 204 are configured to receive fasteners (not shown) for securing the block body 102 to the front cylinder head 300. The block body 102 is also represented as having recesses 106 that encircle the mounting holes 104 at the outer face 103A in order to receive part if not the entire head of each fastener.

The block body 102 comprises an oil inlet 108 having a first opening 108A located on the outer face 103A adjacent an upper end of the block body 102, a second opening 108B located on the inner face 103B of the block body 102, and a passage 108C within the block body 102 that fluidically connects the first and second openings 108A and 108B of the oil inlet 108. The block body 102 also comprises an oil outlet 110 having a first opening 110A located on the sidewall 105 adjacent a lower end of the block body 102, a second opening 1108 located on the inner face 103B of the block body 102, and a passage 110C within the block body 102 that fluidically connects the first and second openings 110A and 1108 of the oil outlet 110. The second openings 108B and 1108 on the inner face 103B of the block body 102 are surrounded by collars 108D and 110D, respectively, that facilitate the connection and sealing of the front oil distribution block 100 to the front cylinder head 300.

The oil inlet 108 is configured to couple with a front cylinder head feed line 306 or a fitting therebetween (e.g., elbow fitting 310) and fluidically connect the front cylinder head feed line 306 with an inlet of the cooling passage that is routed through the front cylinder head 300 of the engine. Similarly, the oil outlet 110 is configured to couple with a return oil line 312 or a fitting therebetween (e.g., a tube 316 with fittings) and fluidically connect the return oil line 312 with an outlet of the cooling passage of the front cylinder head 300.

The first opening 108A of the oil inlet 108 and the first opening 110A of the oil outlet 110 located on the outer face 103A of the block body 102 may be configured to threadably mate with the front cylinder head feed line 306 and the return oil line 312, respectively, or threaded fittings therebetween. For examples in which the first opening 108A and the first opening 110A include female threaded connections, the first openings 108A and 110A may include threads on inner walls thereof, may be encircled by recesses having threads on inner walls thereof, or may be encircled by fittings that protrude from the outer face 103A and have threads on inner walls thereof.

Figure 2B:
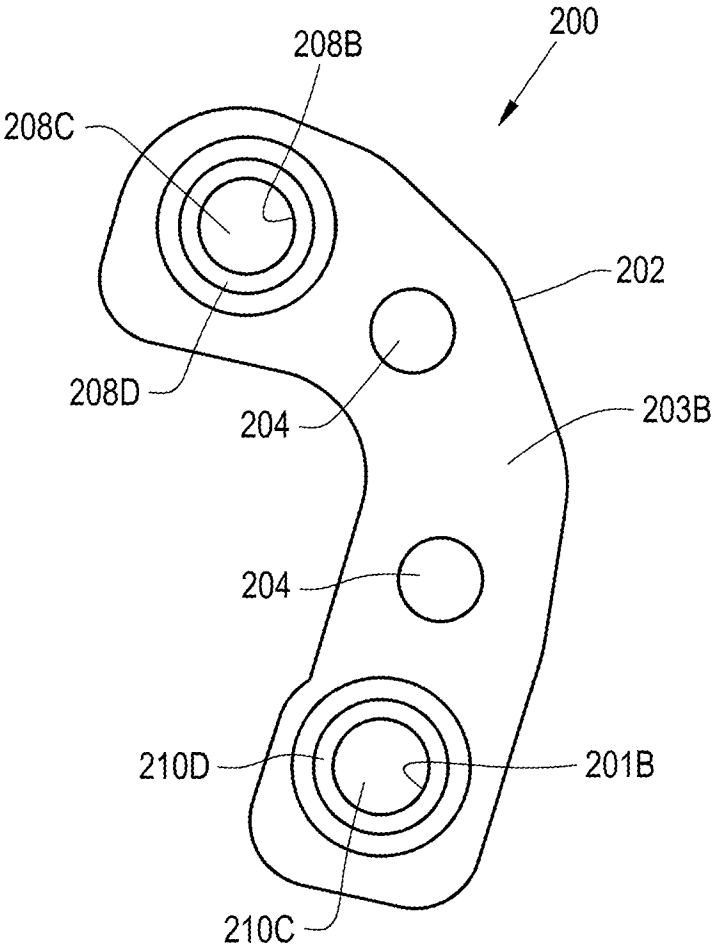
FIGS. 2A and 2B represent views of opposite surfaces of a rear oil distribution block in accordance with certain nonlimiting aspects of the invention.
Figure 2A:
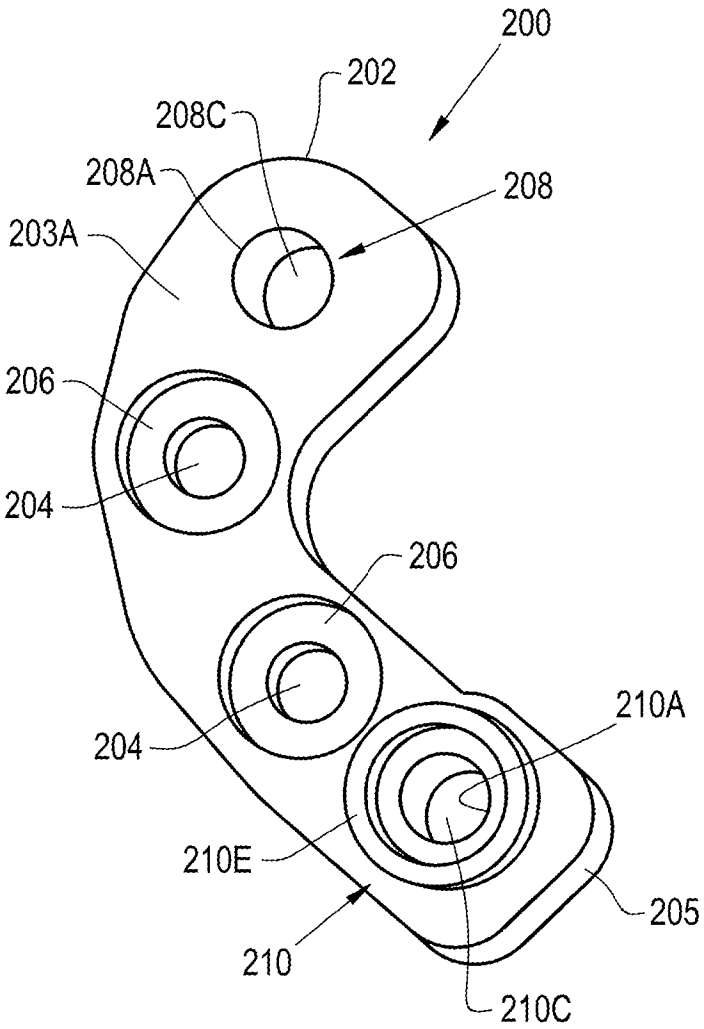

The rear oil distribution block 200 is represented in FIGS. 2A and 2B as comprising a rigid block body 202 configured to couple with the rear cylinder head 302 of the engine. In certain cases, the rear oil distribution block 200 may be a replacement for a rear manifold that is factory standard for the Harley-Davidson® M8 engine. The block body 202 may generally be described as having a rounded L-shape with an outer face 203A configured to face outward away from the rear cylinder head 302, and an inner face 203B that is opposite the outer face 203A and configured to face inward toward the rear cylinder head 302. The block body 202 has a continuous sidewall 205 that is between and separates the outer face 203A and the inner face 203B.

The block body 202 includes a pair of mounting holes 204 having axes that are depicted as roughly perpendicular to the outer face 203A. The mounting holes 204 are configured to receive fasteners (not shown) for securing the block body 202 to the rear cylinder head 302. The block body 202 is also represented as having recesses 206 that encircle the mounting holes 204 at the outer face 203A in order to receive part if not the entire head of each fastener.

The block body 202 comprises an oil inlet 208 having a first opening 208A located on the outer face 203A of the block body 202 adjacent an upper end of the block body 202, a second opening 208B located on the inner face 203B of the block body 202, and a passage 208C within the block body 202 therebetween that fluidically connects the first and second openings 208A and 208B of the oil inlet 208. The block body 102 also comprises an oil outlet 210 having a first opening 210A located on the outer face 203A adjacent a lower end of the block body 202, a second opening 210B located on the inner face 203B of the block body 202, and a passage 210C within the block body 102 that fluidically connects the first and second openings 210A and 210B of the oil outlet 210. The openings 208B, 210A, and 210B are surrounded by collars 208D, 2110E, and 210D, respectively, that facilitate the connection and sealing of the front oil distribution block 100 to the front cylinder head 300 and a Tee fitting 322 (discussed below).

The oil inlet 208 is configured to couple with the rear cylinder head feed line 324 or a fitting therebetween (e.g., elbow fitting 328) and fluidically connect the rear cylinder head feed line 324 with an inlet of the cooling passage that is routed through the rear cylinder head 302 of the engine. The oil outlet 210 is configured to couple with the Tee fitting 322, which recombines the oil from an outlet of the cooling passage flowing through the rear oil distribution block 200 and the oil flowing from the return oil line 312 and fluidically connects the combined oil flow to a rear oil line 330.

The first openings 208A and 210A of the oil inlet 208 and oil outlet 210 may be configured to threadably mate with the rear cylinder head feed line 324 and the Tee fitting 322, respectively, or threaded fittings therebetween. For examples in which the first openings 208A and 210A include female threaded connections, the first openings 208A and 210A may include threads on inner walls thereof, may be encircled by recesses having threads on inner walls thereof, or may be encircled by fittings that protrude from the outer face 203A having threads on inner walls thereof.

FIGS. 3 through 6 represent certain aspects of nonlimiting examples showing the front and rear distribution blocks 100 and 200 as parts of an external oil distribution system installed on a Harley-Davidson® M8 engine. It should be understood that certain components and/or configurations represented in FIGS. 3 through 6 could be replaced with other components and/or configurations.

Figure 3:
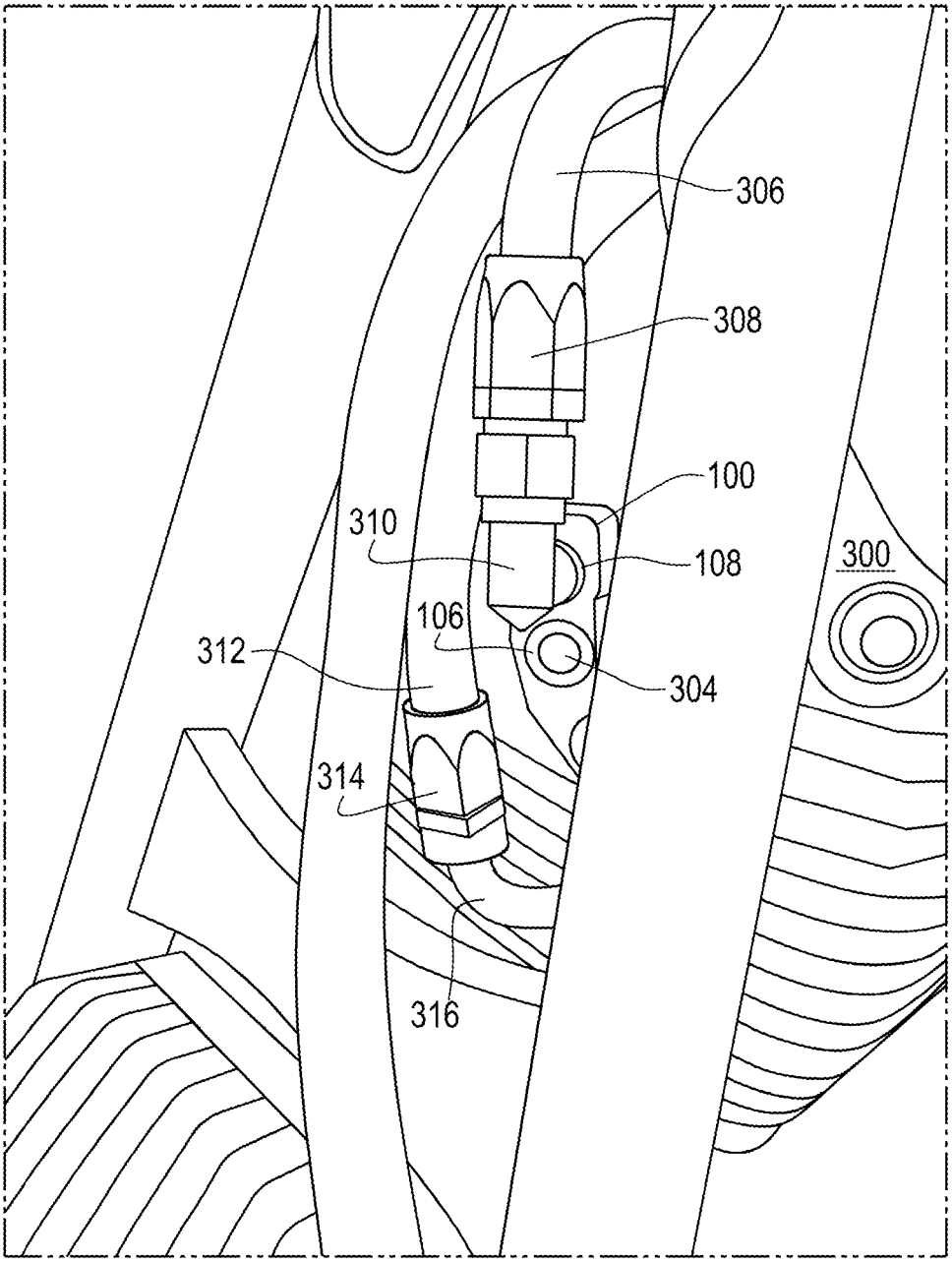
FIGS. 3 through 6 represent the front and rear oil distribution blocks of FIGS. 1A, 1B, 2A, and 2B as installed on a Harley-Davidson® M8 engine in accordance with a nonlimiting embodiment of the invention.

FIG. 3 represents the front distribution block 100 as secured to the front cylinder head 300 of the engine with bolts 304 (one of which is visible) that pass through the mounting holes 104 with heads of the bolts 304 received within the recesses 106 encircling the mounting holes 104. A line end fitting 308 of the flexible, braided front cylinder head feed line 306 is coupled to the elbow fitting 310 which in turn is coupled to the first opening 108A of the oil inlet 108 at the upper end of the front distribution block 100. A line end fitting 314 (referred to herein as the front line end fitting 314) of the flexible, braided return oil line 312 is coupled to the tube 316 (partially obscured) which is U-shaped and coupled to the first opening 110A of the oil outlet 110 (not visible) located on the sidewall 105 at the lower end of the front distribution block 100.

Figure 4:
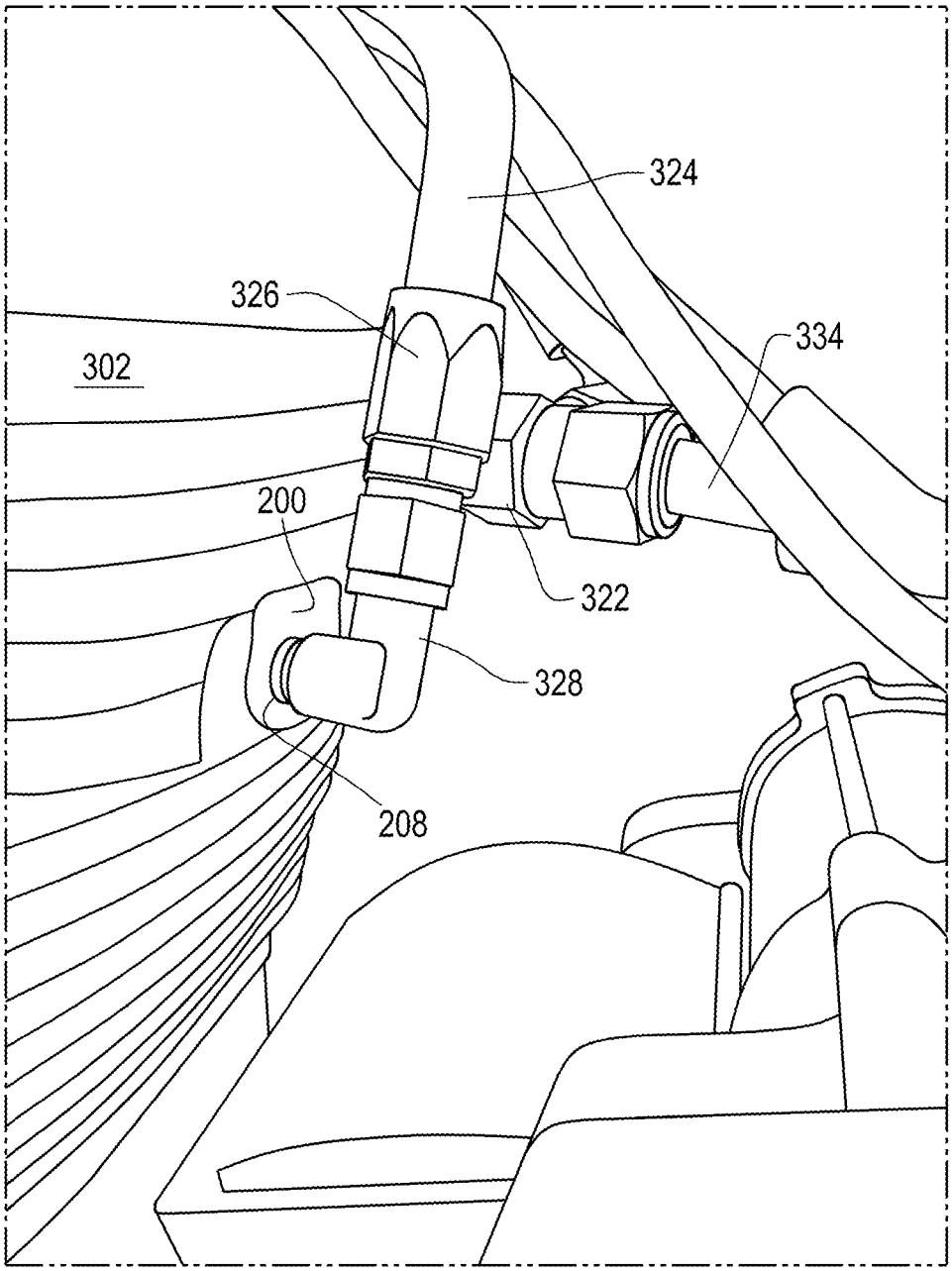
Figure 5:
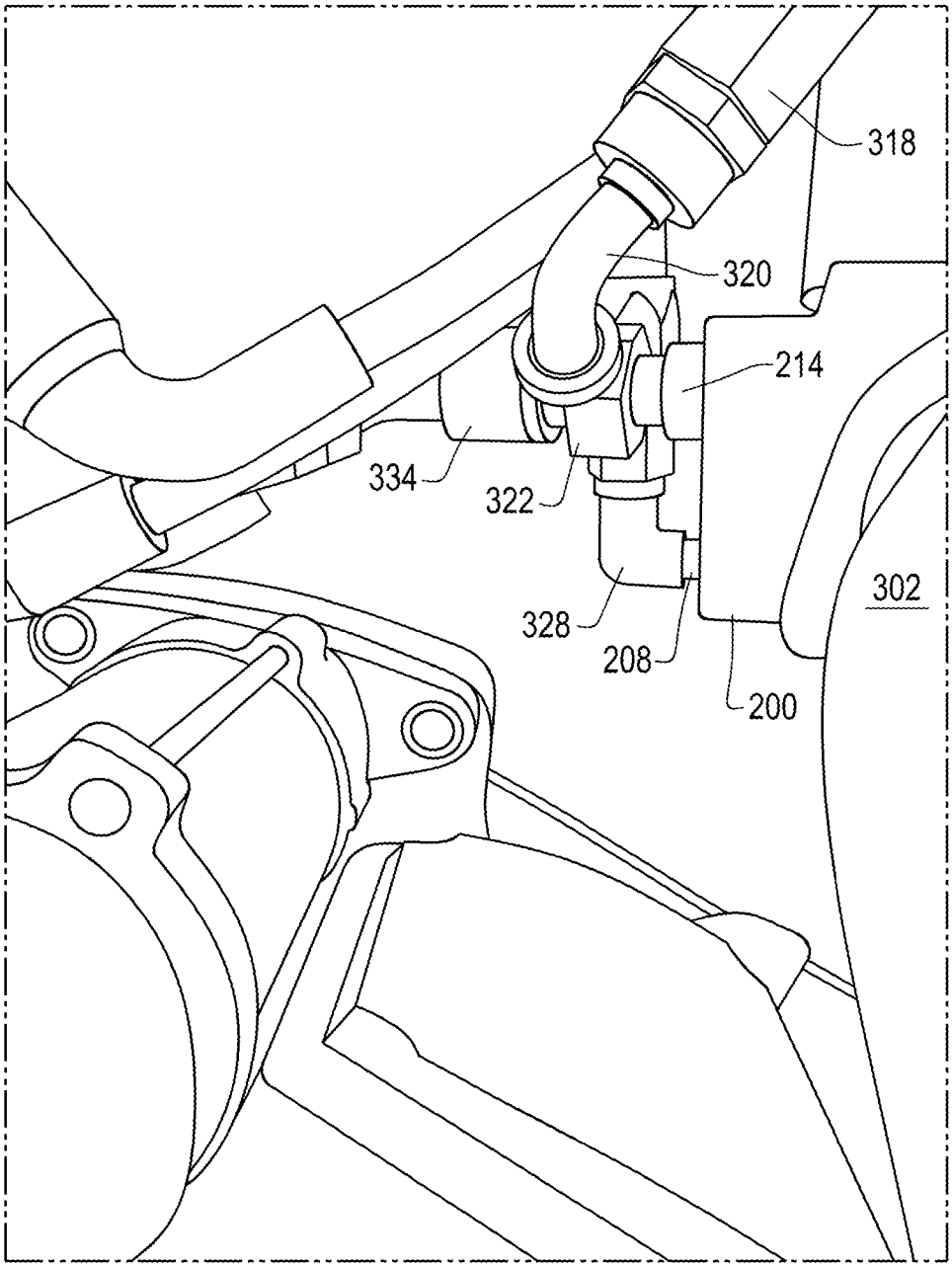
Figure 6:
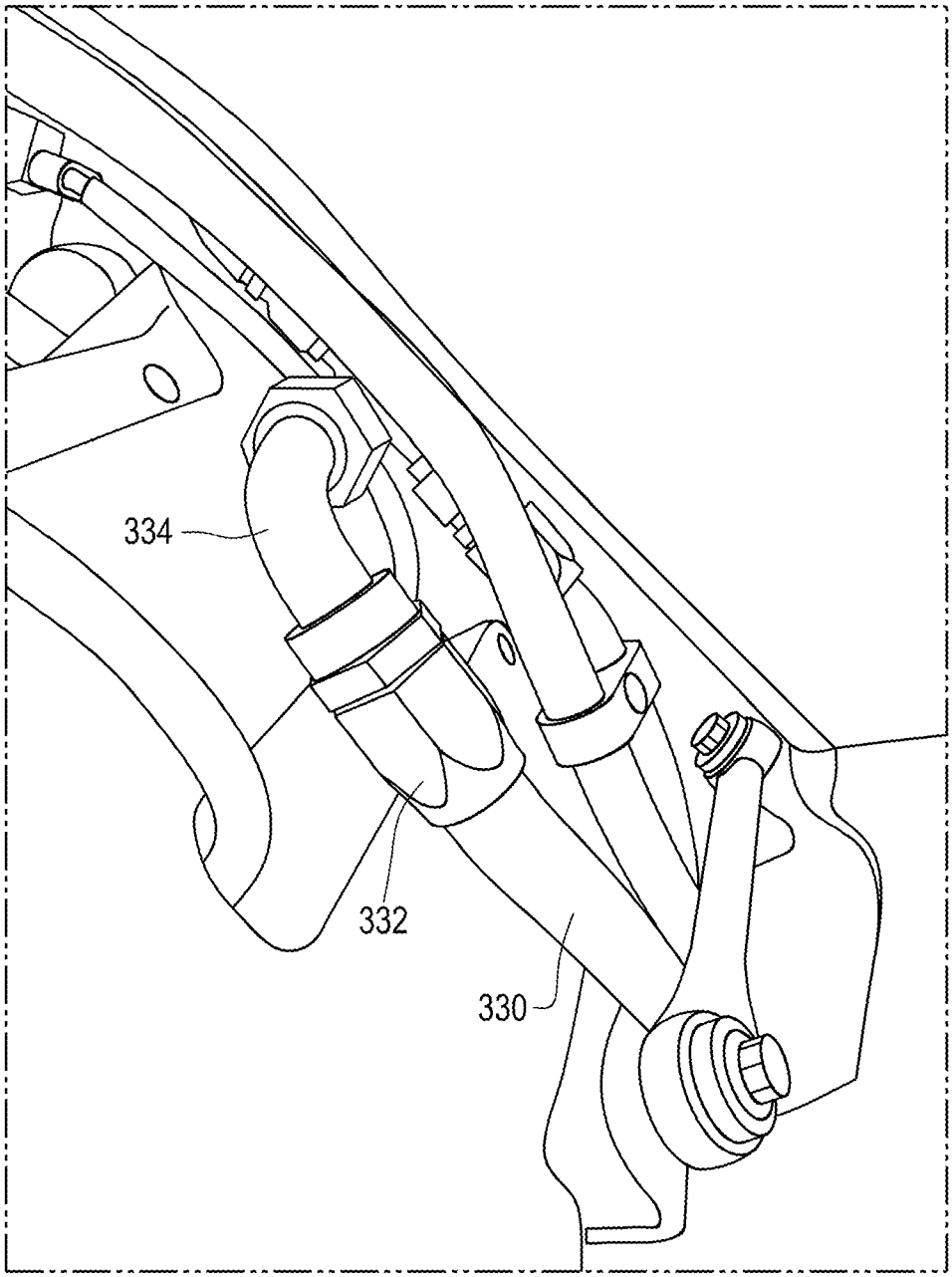

FIGS. 4 through 6 represent the rear distribution block 200 as secured to the rear cylinder head 302 of the engine with bolts 304 that pass through the mounting holes 204 with heads of the bolts 304 (not visible) received within the recesses 206 encircling the mounting holes 204. A line end fitting 326 of the flexible, braided rear cylinder head feed line 324 is coupled to the elbow fitting 328 which in turn is coupled to the first opening of the oil inlet 208 of the rear distribution block 200. The Tee fitting 322 is coupled to the first opening 210A of the oil outlet 210 of the rear distribution block 200, a line end fitting 318 (referred to herein as the rear line end fitting 318) of the flexible, braided return oil line 312 via an elbow fitting 320, and a line end fitting 332 of the flexible, braided rear oil line 330 via an elbow fitting 334.

In certain cases, the external oil distribution system represented in FIGS. 3 through 6 may be installed as a replacement for certain components of a factory standard oil distribution system of the Harley-Davidson® M8 engine. In such cases, the method of replacing the original factory standard system may include initially removing factory standard front and rear cylinder head feed lines, a factory standard return oil line, and a factory standard rear oil hose of the factory standard oil distribution system. Thereafter, a factory standard front manifold may be removed from a first location on the front cylinder head 300, and a factory standard rear manifold may be removed from a second location on the rear cylinder head 302.

Once these components have been removed, the front oil distribution block 100 may be secured to the front cylinder head 300 at the first location and the rear oil distribution block 200 may be secured to the rear cylinder head 302 at the second location. Optionally, the front and rear oil distribution blocks 100 and 200 may be secured with original, factory standard mounting bolts that were previously used to secure the front and rear manifolds. Once secured, the front and rear cylinder head feed lines 306 and 324 may be threadably coupled to the oil inlets 108 and 208 of the front and rear oil distribution blocks 100 and 200, respectively, directly or via the fittings therebetween, the return oil line 312 and the Tee fitting 322 may each be threadably coupled to the oil outlets 110 and 210 of the front and rear oil distribution blocks 100 and 200, respectively, directly or via the fittings therebetween, and the return oil line 312 and the rear oil line 330 may each be threadably coupled to the Tee fitting 322 directly or via the fittings therebetween.

Once the components of the replacement external oil distribution system have been assembled as described above, they may be connected to the remainder of the original oil distribution system of the M8 engine. This may include fluidically connecting the front and rear cylinder head feed lines 306 and 324 to a downtube that is fluidically coupled to an oil cooler, and/or fluidically connecting the rear oil line 330 to an oil pan.

In view of the above, the front and rear oil distribution blocks 100 and 200 allow for easy removal of the oil distribution lines that are connected to the front and rear cylinder heads 300 and 302. In certain cases, the front and rear oil distribution blocks 100 and 200 may be components of a kit that includes flexible, braided oil distribution lines (e.g., the front and rear cylinder head feed lines 306 and 324, the return oil line 312, and/or the rear oil line 330) and corresponding fittings that in combination are configured to replace the factory standard front and rear manifolds and hard line and/or other oil distribution lines provided with the Harley-Davidson® M8 engine. Such configurations may promote ease of maintenance of the exterior oil distribution system, especially by end users. In addition, various components of the front and rear oil distribution blocks 100 and 200, the oil distribution lines, and/or the fittings therebetween may be configured to provide aesthetic modifications to the engine. For example, such components may include various colored coatings that provide a consistent or otherwise aesthetically pleasing appearance.

As previously noted above, though the foregoing detailed description describes certain aspects of one or more particular embodiments of the invention, alternatives could be adopted by one skilled in the art. For example, the front and rear oil distribution blocks 100 and 200 could differ in appearance and construction from the embodiment described herein and shown in the figures, functions of certain components of the front and rear oil distribution blocks 100 and 200 could be performed by components of different construction but capable of a similar (though not necessarily equivalent) function, and various materials could be used in the fabrication of the front and rear oil distribution blocks 100 and 200 and/or their components. As such, and again as was previously noted, it should be understood that the invention is not necessarily limited to any embodiment described herein or illustrated in the drawings.

The invention claimed is:

1. An oil distribution block comprising:

a rigid block body configured to be secured to a cylinder head of an engine;

an oil inlet configured to be releasably coupled to a first oil distribution line or a fitting therebetween, receive oil therefrom, and route the oil to an inlet of a cooling passage of the cylinder head; and an oil outlet configured to be releasably coupled to a second oil distribution line or a fitting therebetween, receive the oil from an outlet of the cooling passage of the cylinder head, and route the oil to the second oil distribution line;

wherein the oil inlet and the oil outlet are configured to threadably couple with the first and second oil distribution lines, respectively, or the fittings therebetween; and wherein the engine is a motorcycle engine and the cylinder head is a front cylinder head of the engine.

2. The oil distribution block of claim 1, further comprising one or more mounting holes in the block body each configured to receive a fastener for securing the block body to the cylinder head.

3. An oil distribution block comprising:

a rigid block body configured to be secured to a cylinder head of an engine;

an oil inlet configured to be releasably coupled to a first oil distribution line or a fitting therebetween, receive oil therefrom, and route the oil to an inlet of a cooling passage of the cylinder head; and an oil outlet configured to be releasably coupled to a second oil distribution line or a fitting therebetween, receive the oil from an outlet of the cooling passage of the cylinder head, and route the oil to the second oil distribution line;

wherein the oil inlet and the oil outlet are configured to threadably couple with the first and second oil distribution lines, respectively, or the fittings therebetween; and wherein the engine is a motorcycle engine and the cylinder head is a rear cylinder head of the engine.

4. The oil distribution block of claim 1, wherein the block body defines a rounded L-shape.

5. The oil distribution block of claim 1, wherein the block body is configured to replace a factory standard manifold secured to the cylinder head.

6. An external oil distribution system for directing a flow of oil to and from cooling passages of front and rear cylinder heads of a motorcycle engine, the external oil distribution system comprising:

front and rear cylinder head feed lines configured to transport oil to the cooling passages of the front and rear cylinder heads, respectively;

a Tee fitting configured to receive and combine the oil from the cooling passages of the front and rear cylinder heads;

a return oil line configured to transport the oil from the cooling passage of the front cylinder head to the Tee fitting;

a rear oil line configured to receive the oil from the Tee fitting;

a front oil distribution block comprising:

a rigid block body configured to be secured to the front cylinder head;

an oil inlet configured to be releasably coupled to the front cylinder head feed line or a fitting therebetween, receive the oil therefrom, and route the oil to an inlet of the cooling passage of the front cylinder head; and an oil outlet configured to be releasably coupled to the return oil line or a fitting therebetween, receive the oil from an outlet of the cooling passage of the front cylinder head, and route the oil to the return oil line; and a rear oil distribution block comprising:

a rigid block body configured to be secured to the rear cylinder head;

an oil inlet configured to be releasably coupled to the rear cylinder head feed line or a fitting therebetween, receive the oil therefrom, and route the oil to an inlet of the cooling passage of the rear cylinder head; and an oil outlet configured to be releasably coupled to the Tee fitting, receive the oil from an outlet of the cooling passage of the rear cylinder head, and route the oil to the Tee fitting;

wherein the oil inlet and the oil outlet of both of the front and rear oil distribution blocks include threads configured to threadably couple with one or more of the front and rear cylinder head feed lines, the Tee fitting, the return oil line, the rear oil hose, or the fittings therebetween.

7. The external oil distribution system of claim 6, further comprising one or more mounting holes in the block body of each of the front and rear oil distribution blocks, each of the mounting holes configured to receive a fastener for securing to the respective one of the front and rear cylinder heads.

8. The external oil distribution system of claim 6, wherein the block body of each of the front and rear oil distribution blocks defines a rounded L-shape.

9. The external oil distribution system of claim 6, wherein the front and rear cylinder head feed lines, the return oil line, and the rear oil line are flexible.

10. The external oil distribution system of claim 6, wherein the front oil distribution block is configured to replace a factory standard front manifold secured to the front cylinder head, and the rear oil distribution block is configured to replace a factory standard rear manifold secured to the rear cylinder head.

11. The external oil distribution system of claim 6, wherein the front and rear cylinder head feed lines, the Tee fitting, the return oil line, the rear oil line, and the fittings therebetween, if any, are configured to replace factory standard front and rear cylinder head feed lines, a factory standard return oil line, and a factory standard rear oil hose, respectively.

12. A method of modifying a factory standard oil distribution system of a motorcycle engine with the external oil distribution system of claim 6, the method comprising:

removing factory standard front and rear cylinder head feed lines, a factory standard return oil line, and a factory standard rear oil hose of the factory standard oil distribution system;

removing a factory standard front manifold from a first location on the front cylinder head, and a factory standard rear manifold from a second location on the rear cylinder head;

securing the front oil distribution block to the front cylinder head at the first location and the rear oil distribution block to the rear cylinder head at the second location;

threadably coupling the front and rear cylinder head feed lines to the oil inlets of the front and rear oil distribution blocks, respectively, directly or via the fittings therebetween;

threadably coupling the return oil line and the Tee fitting to the oil outlets of the front and rear oil distribution blocks, respectively, directly or via the fittings therebetween;

threadably coupling the return oil line and the rear oil line to the Tee fitting directly of via the fittings therebetween.

13. The method of claim 12, further comprising:

fluidically connecting the front and rear cylinder head feed lines to a downtube that is fluidically coupled to an oil cooler; and fluidically connecting the rear oil line to an oil pan.

14. A kit comprising the front oil distribution block and the rear oil distribution block of claim 6.

15. The kit of claim 14, further comprising the front and rear cylinder head feed lines, the return oil line, the Tee fitting, and the rear oil line.

16. The kit of claim 14, further comprising the fittings configured for connection between respective pairs of the front and rear oil distribution blocks, the front and rear cylinder head feed lines, the return oil line, the Tee fitting, and the rear oil line.

17. The oil distribution block of claim 3, further comprising one or more mounting holes in the block body each configured to receive a fastener for securing the block body to the cylinder head.

18. The oil distribution block of claim 3, wherein the block body defines a rounded L-shape.

19. The oil distribution block of claim 3, wherein the block body is configured to replace a factory standard manifold secured to the cylinder head.

* * * * *